US006571592B1

(12) United States Patent
Zheng et al.

(10) Patent No.: US 6,571,592 B1
(45) Date of Patent: Jun. 3, 2003

(54) ROLLING MILL WITH ROLL DEFLECTION BI-DIMENSIONALLY CONTROLLED

(76) Inventors: Hongzhuan Zheng, Bldg.3, No. 14, Jingqi Rd., Zhengzhou City, Henan Province 450002 (CN); Linzhen Zhao, Bldg.3, No. 14, Jingqi Rd., Zhengzhou City, Henan Province 450002 (CN)

( * ) Notice: Subject to any disclaimer, the term of this patent is extended or adjusted under 35 U.S.C. 154(b) by 0 days.

(21) Appl. No.: 09/914,332

(22) PCT Filed: Mar. 4, 1999

(86) PCT No.: PCT/CN99/00026

§ 371 (c)(1),
(2), (4) Date: Nov. 9, 2001

(87) PCT Pub. No.: WO00/51754

PCT Pub. Date: Sep. 8, 2000

(51) Int. Cl.[7] ..... B21B 29/00
(52) U.S. Cl. ..... 72/242.4; 72/242.2
(58) Field of Search ..... 72/237, 238, 241.2–241.6, 72/242.2, 242.4, 243.2, 243.4

(56) References Cited

U.S. PATENT DOCUMENTS 4,197,731 A * 4/1980 Verbickas et al. ..... 72/243.4
4,402,207 A * 9/1983 Buder ..... 72/241.2
4,462,236 A * 7/1984 Turley et al. ..... 72/243.4
5,609,054 A * 3/1997 Ogawa et al. ..... 72/14.1

* cited by examiner

*Primary Examiner*—Allen Ostrager
*Assistant Examiner*—John S Goetz
(74) *Attorney, Agent, or Firm*—Sheridan Ross PC

(57) ABSTRACT

The present invention is generally directed to a rolling mill in which the supporting means are arranged in the middle region of the roll body of the working roll with their length(s) not longer than that of the roll body of the working roll. The supporting means supports or abuts against the middle and lateral roll supports at their central region in the axial direction during the operation of the rolling mill so as to provide central support to the roll supports. As a result, the middle and lateral roll supports and hence the rolls will not deflect or bend under the action of rolling force.

8 Claims, 5 Drawing Sheets

ROLLING MILL WITH ROLL DEFLECTION BI-DIMENSIONALLY CONTROLLED

FIELD OF THE INVENTION

The invention generally relates to a rolling mill for producing plate and strip, and in particular to a rolling mill in which two-dimensional central support is automatically formed so as to control the roll's flexure, thereby the rolled plate and strip have very high thickness precision in cross section.

BACKGROUND OF THE INVENTION

Generally, there are a variety of kinds of rolling mills for rolling plate and strip, and they are classified according to the number of rolls into the two-high mill, the four-high mill and the cluster mill, but the most commonly used rolling mills are the four-high mill, the HC mill and the cluster mill and so on. For two-high type, four-high type mills, there exist many disadvantages, the main disadvantage is that: when a piece to be rolled passes the mill stand, since the downward driving devices are located at the necks of the rolls, the rolls are caused to have larger bending deformation, and the deformations of the rolls will result in the thickness error in the cross section of the rolled piece (rolled plate and strip), thus seriously affecting the quality of the rolled piece. To solve the above problem, the method of increasing the diameter of the rolls has to be adopted, and for a four-high mill, also the method of increasing the diameter of the supporting rolls has to be adopted. However, as the diameter of the rolls increases, it is certain to cause the rolling forces to abruptly increase, and the increase of the rolling forces in turn causes an increase of the bending deformation of the rolls.

The cluster mills include integral housing type mills and open type mills (as shown in FIGS. 1, 2), Japanese Patent 54-1259 discloses a cluster mill which adopts a tower-like roll system. Of course, such rolling mills all have the advantage of high rigidity, but in a cluster mill, the portions of the mill frame which contact the supporting rolls still have bending deformation under rolling forces, thus causing the flexural deformation of the working rolls and affecting the uniformity of the thickness of rolled piece as a result.

The solution to the problem of the roll's flexural deformation to reduce or eliminate the effect of the roll's flexural deformation on the thickness of rolled piece consists in the control of the shape of the clearance between the working rolls to make the flexural deformation of the working rolls not to be affected by the change of rolling forces. A Chinese Patent (application number 89101393, issue number CN 1013250B) discloses "A rolling mill with rolls of small flexure and high rigidity". To achieve above object, according to the patent, the supporting rolls at the outermost layer of the tower-like roll system are supported on the roll supports in the form of a mufti-section beam; rolling forces acting on the working rolls are transmitted respectively to the upper and lower roll supports via the roll systems; the vertical component of the force borne by the roll supports are transmitted to the mill frame via the downward driving or upward driving devices or similar elements such as pads; the number of the downward driving or upward driving devices is at least two, and the positions of the downward driving or upward driving devices are in the middle region of the axis of the working roll on the roll supports. It can be seen, the solution of that patent can make the flexural deformation of the roll supports in the vertical plane not vary with the rolling forces in the main, thus effectively reducing the thickness error in the cross-section of the rolled piece. However, for the cluster mills with tower-like roll systems, the force transmitted from the working rolls to the intermediate rolls has vertical and horizontal components, therefore the peripheral supporting rolls also bear significant horizontal component force. For the rolling mill disclosed in Chinese Patent 89101393, the horizontal component force causes the roll supports to have horizontal flexural deformation, thus causing the axis of the supporting rolls, the intermediate rolls and even the working rolls to have larger flexural deformation.

As stated above, to solve the problem of flexural deformation of the working rolls of a cluster mill, it is not only necessary to reduce the flexural deformation produced by the vertical component force, but also that produced by the horizontal component force, that is, it is obliged to solve the problem of deformation in two-dimensional directions, so that a working roll can be held straight and the thickness precision in the cross-section of the rolled piece can be increased.

SUMMARY OF THE INVENTION

Therefore, the invention is aimed to solve the problem of the two-dimensional flexural deformation of the rolls, namely, the rolling mill of the invention can reduce not only the flexural deformation in vertical direction, but also that in horizontal direction. Accordingly, the object of the invention is to provide a high-precision rolling mill, as compared with the prior art, when the rolling mill of the invention is subjected to the rolling force, the flexural deformation of the rolls can be greatly reduced, resulting in the reduction of the thickness error in the cross-section of the rolled piece and the increase of the dimension accuracy of the rolled piece.

To achieve the above-mentioned object, there is provided a rolling mill for rolling plate and strip comprising: a mill frame; an upper roll system and a lower roll system; and an upper middle roll support, an upper lateral roll support, a lower middle roll support and a lower lateral roll support. The mill frame is of a frame type and is able to bear rolling forces, and all parts and components of the rolling mill, such as the roll systems, are incorporated in the frame. The roll systems are so arranged as to be of a tower-like configuration. The roll system is composed of three parts, a working roll, supporting rolls and intermediate rolls; the upper and lower supporting rolls disposed at the outermost layer of the roll system are respectively supported on the upper and lower middle roll supports and the upper and lower lateral roll supports in the form of a mufti-section beam, and the upper middle roll support and the upper lateral roll support can be moved up and down if necessary to adjust the magnitude of the clearance between the rolls. The mill frame, the roll supports, the central supporting means between the middle roll supports and the lateral roll supports, the central supporting means between the frame and the middle roll supports and the central supporting means between the frame and the lateral roll supports commonly form a two-dimensional central supporting system. The lateral roll supports automatically press tightly against the side walls of the frame under the action of horizontal component force. The central supporting means is disposed on at least one of the upper and lower roll supports, and is arranged in the region near the middle part of the roll body axis of the working roll with its length being not longer than the length of the roll body of the working roll. The central supporting means includes driving devices and horizontal pads; there are at least two driving devices disposed above the upper middle roll support and placed in the mill frame, the lower middle roll support is supported by horizontal pads. Both the driving devices and the horizontal pads are arranged in the region near the middle part of the roll body axis of the working roll. In the rolling mill of invention, there are also disposed upper and lower vertical pads along a horizontal direction, which are respectively positioned between the side surfaces of the upper and lower lateral roll supports and the mill frame. Under the action of horizontal component force, the lateral roll supports press tightly against the side walls of the mill through the vertical pads, thus being centrally supported in the horizontal direction so as to prevent flexural deformation due to horizontal component force. In the rolling mill of the invention, horizontal pads are disposed between the middle roll supports and the lateral roll support to further provide central support to the lateral roll supports in the vertical direction. The shape of the mill frame is mated with that of the combined roll supports.

BRIEF DESCRIPTION OF THE DRAWINGS

The embodiments of the invention will be described in detail in connection with accompanying drawings, and the object of the invention will become more apparent from the following description.

DETAILED DESCRIPTION OF THE PREFERRED EMBODIMENTS

Figure 1:
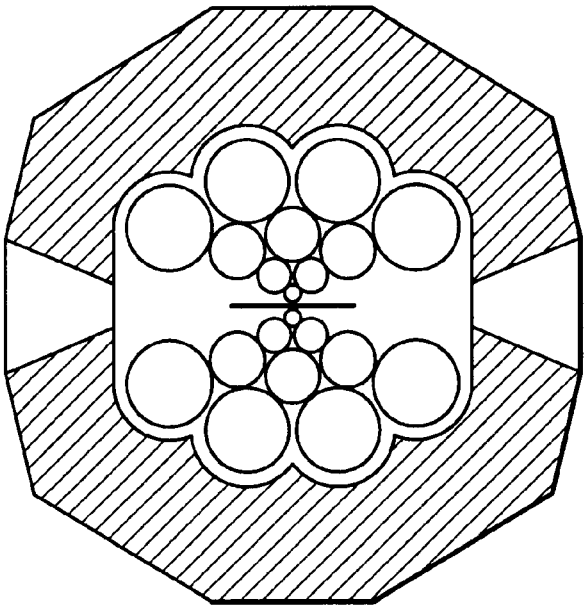
PRIOR ART FIG.1
FIG. 1 is a schematic view of a conventional rolling mill.
Figure 2:
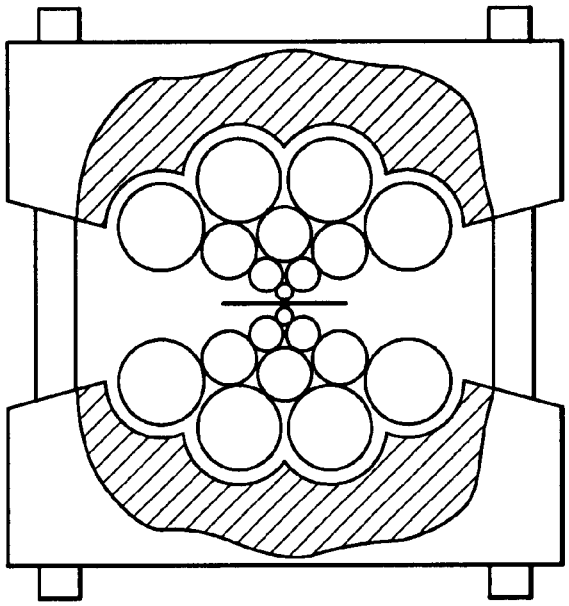
PRIOR ART FIG.2
FIG. 2 is a schematic view of a conventional open type cluster mill.
Figure 3:
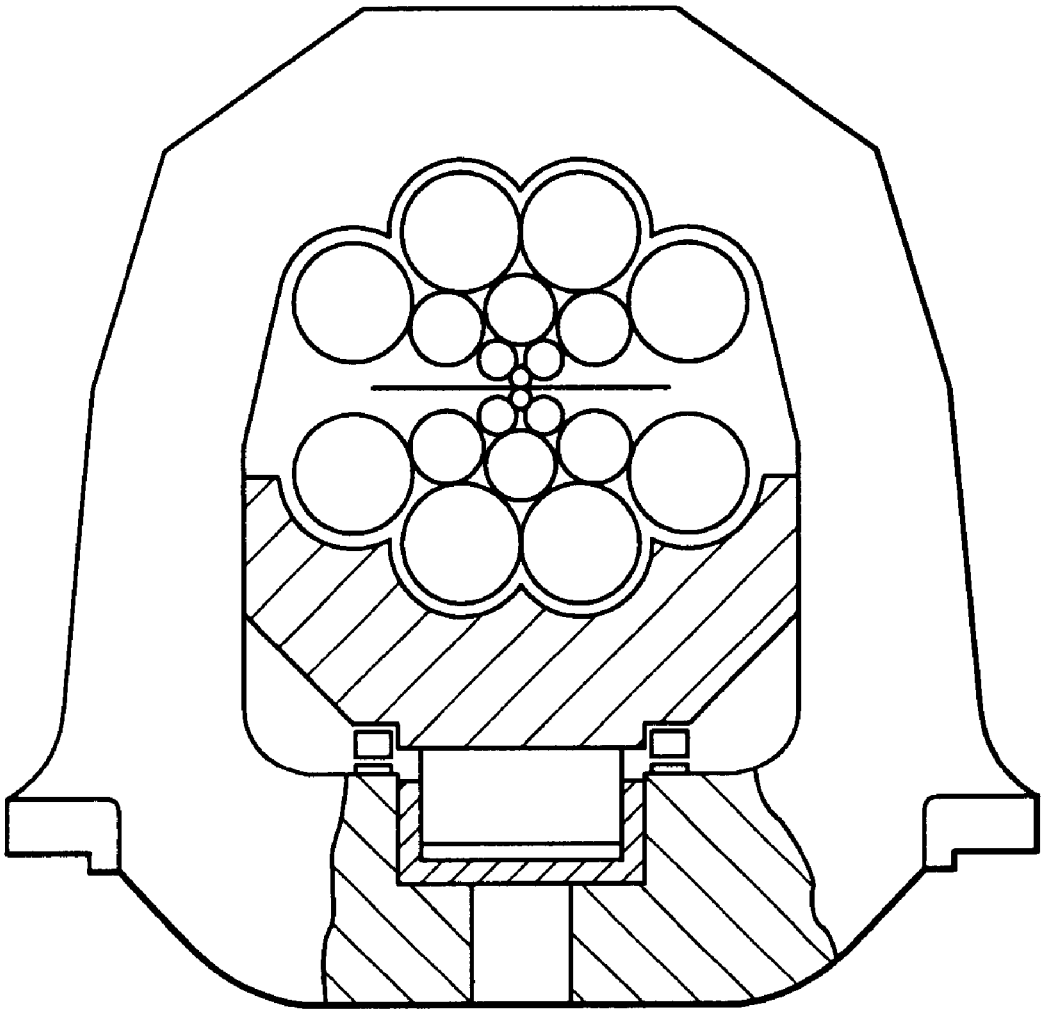
PRIOR ART FIG.3
FIG. 3 is a schematic view of a conventional cluster mill disclosed in a Japanese Patent.

FIGS. 1–3 are schematic views showing the commonly used conventional rolling mills. Due to their structure, it is inevitable for the rolls to deflect during rolling, and this will directly affect the quality of the rolled piece. Therefore, the surface precision of the rolled piece, especially the thickness precision of plate, can not meet the requirements.

Figure 4:
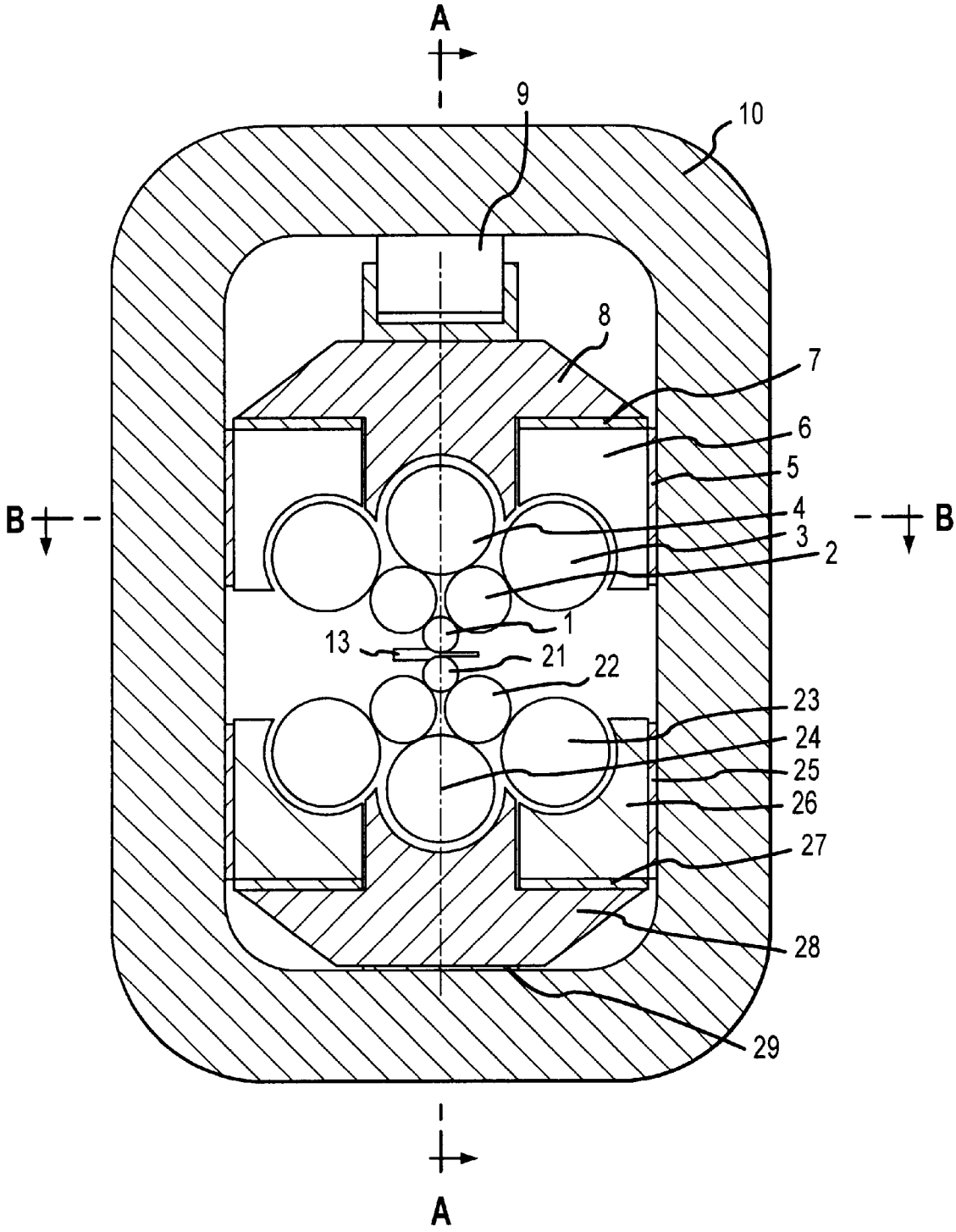
FIG. 4 is a front sectional view of the rolling mill in accordance with the invention.
Figure 5:
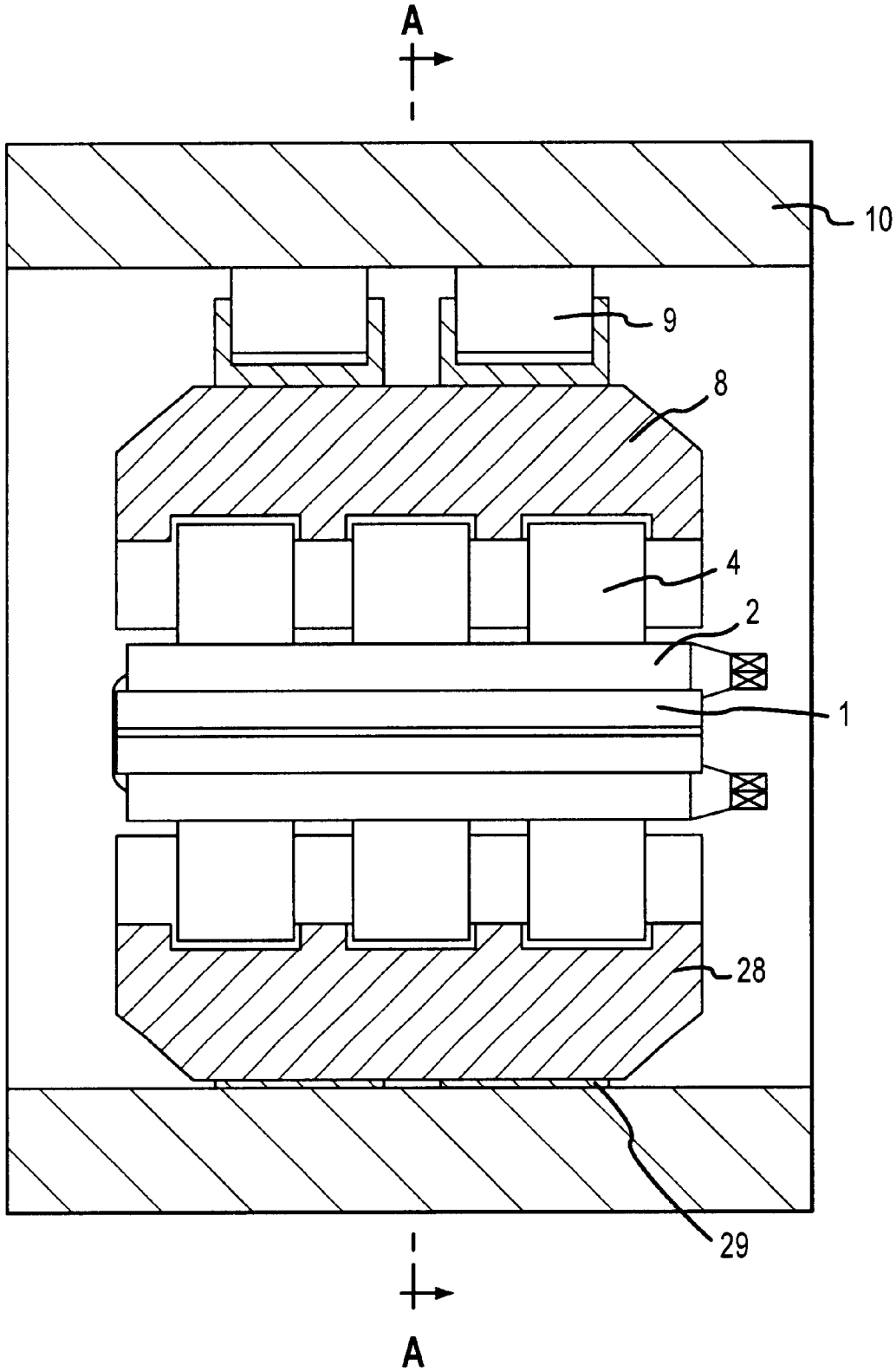
FIG. 5 is a sectional view of the rolling mill taken along line A—A in FIG. 4.
Figure 6:
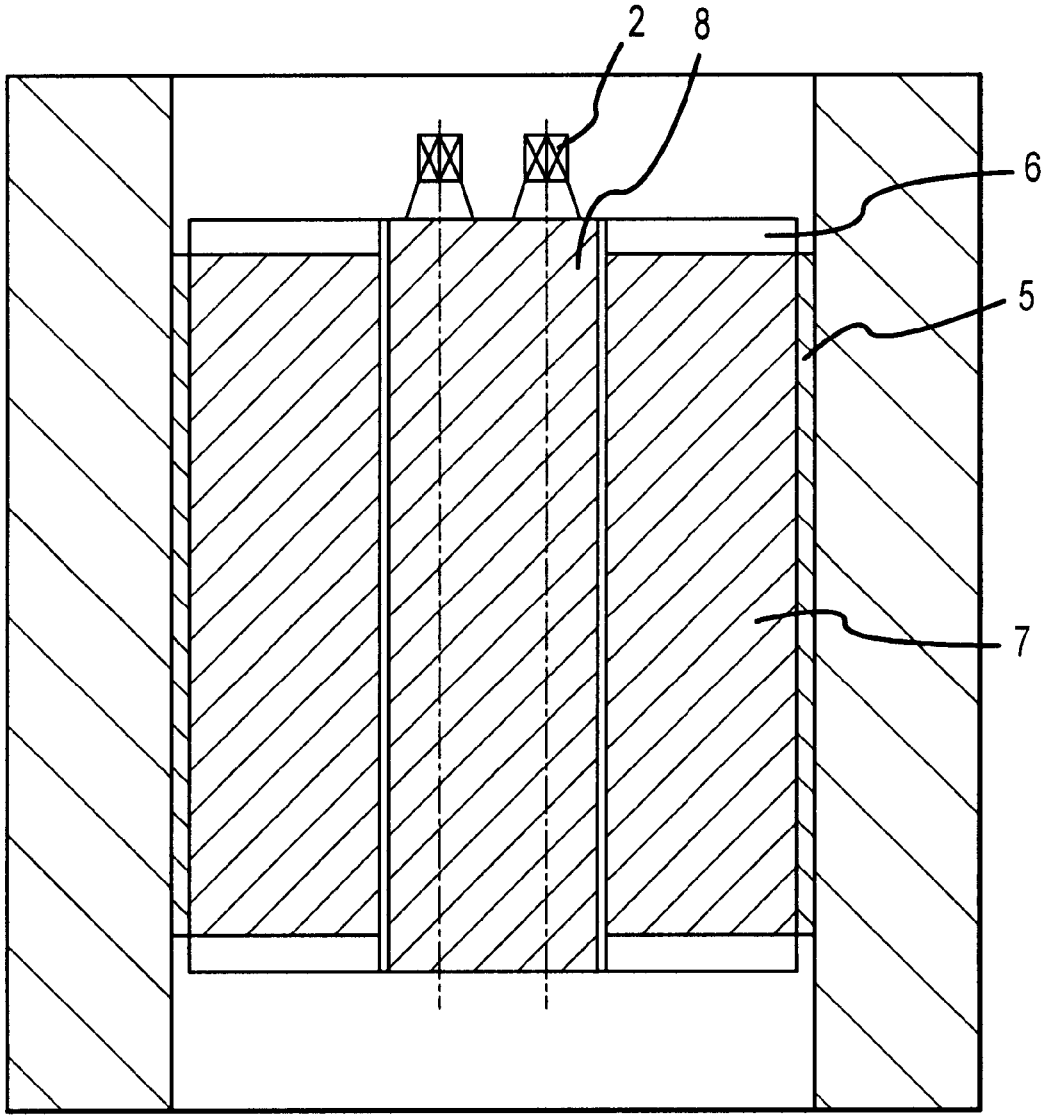
FIG. 6 is a sectional view of the rolling mill taken along line B—B in FIG. 4.

FIGS. 4–6 show the embodiment of the high-precision rolling mill with flexures being controlled two-dimensionally in accordance with the invention. As can be seen in FIG. 4, a two-dimensional central supporting system comprises a frame 10, middle roll supports 8 and 28, lateral roll supports 6 and 26, pads 5, 25, 7, 27 and 29, and driving devices 9. In the frame 10 there are provided the main parts and components such as the upper and lower roll systems, the upper and lower middle roll supports 8 and 28, the upper and lower lateral roll supports 6 and 26, and etc. The frame 10 can be formed into an integral one, or can be formed by several parts connected together by means of welding or other connecting methods. The upper and lower roll systems are respectively composed of a working roll 1 and 21, intermediate rolls 2 and 22, and supporting rolls 3, 23 and 4, 24, which form a tower-like roll system together. The rolled piece is designated by reference numeral 13. The supporting rolls 3, 23 and 4, 24 at the outermost layer of the roll system are supported in the form of a multi-section beam, generally two or more section beam (refer to FIG. 5), on the upper and lower lateral roll supports 6, 26 and upper and lower middle roll supports 8, 28. In the central supporting system, the driving devices 9 are provided between the upper middle roll support 8 and the upper inner wall of the frame 10, the device 9 is positioned on the upper middle roll support and located at the middle region of the axis of the working roll, generally located within the length of the roll body of the working roll. The driving devices 9 can move up and down, causing the upper middle roll support 8 and the upper lateral roll supports 6 to move together up and down in the integral frame 10 to adjust the clearance between the rolls. For carrying out automatic control, the driving devices can also be equipped with an automatic sheet thickness controlling device (not shown) so as to accurately detect the magnitude of the rolling force and the clearance between the rolls. Therefore, the production can be automated to obtain high precision products.

Between the lower middle roll support 28 and the lower inner wall of the frame 10 there are disposed horizontal pads 29 (FIG. 4), the horizontal pads are placed under the lower middle roll support and located at the middle region of the axis of the working roll, generally located within the length of the roll body of the working roll. Obviously, the lower middle roll support 28 is supported by the horizontal pads 29. The horizontal pads 29 can be of different sizes, namely, the thickness of the horizontal pads can form a thickness series. The adjustment of the rolling line can be realized by using horizontal pads 29 of different thickness. And also, the horizontal pads 29 can be replaced by a hydraulic device or a screw device.

Referring to FIGS. 4, 5 and 6, it can be clearly seen from FIG. 4 that the upper middle roll support 8 is supported vertically by the driving devices 9, while the upper lateral roll supports 6 are supported vertically on the upper middle roll support 8 through pads 7 and can slide in the horizontal direction. Between the upper lateral roll supports 6 and the frame 10 there are disposed vertical pads 5, thus the upper lateral roll supports 6 press against the frame 10 tightly through the vertical pads 5 under the action of the horizontal component force. The driving devices 9, pads 7 and vertical pads 5 are located at the middle region of the axis of the working roll, being within the length of the roll body of the working roll. Similarly, the lower middle roll support 28 is supported vertically by the pads 29, while the lower lateral roll supports 26 are supported vertically on the lower middle roll support 28 through pads 27 and can slide in the horizontal direction. Between the lower lateral roll supports 6 and the frame 10 there are disposed vertical pads 25, thus the lower lateral roll supports 26 press against the frame tightly through the vertical pads 25 under the action of the horizontal component force. The pads 29, 27 and the vertical pads 25 are located at the middle region of the axis of the working roll, being within the length of the roll body. The lower roll support composed of the lower middle roll support 28, the lower lateral roll supports 26 and the pads 27, together with the pads 29 and vertical pads 25, is supported on the mill frame 10. And the upper roll support composed of the upper middle roll support 8, the upper lateral roll supports 6 and the pads 7, together with the driving devices 9 and the vertical pads 5, is supported on the frame 10.

Due to the above-mentioned structure of the rolling mill of the invention, the flexures of the rolls are substantially reduced. This is because that the frame, the roll supports, the central supporting means between the middle roll supports and the lateral roll supports, the central supporting means between the frame and the middle roll supports and the central supporting means between the frame and the lateral roll supports form a two-dimensional central supporting system together, namely providing central support in both vertical and horizontal directions. And specifically, the upper and lower roll supports of the mill, and even the supporting rolls, the intermediate rolls and the working rolls are all supported centrally in both horizontal and vertical directions. The rolling forces borne by the working rolls are transmitted to the supporting rolls via the working rolls and the intermediate rolls. The supporting rolls comprise several backing bearings mounted on an mandrel (refer to FIG. 5). Therefore, the outer rings of the bearings rotate when the rolling force is transmitted to the outer rings, and the rolling force is then transmitted to the upper middle roll support and the upper lateral roll supports through the bearings. The vertical component force finally reaches the upper inner wall of the frame via the driving devices, and the horizontal component force reaches the side walls of the frame via the vertical pads. Similarly, the rolling force borne by the lower working roll is transmitted to the lower middle roll support and the lower lateral roll support via the intermediate rolls and the supporting rolls, with the vertical component force being transmitted to the lower inner wall of the frame via the pads 29 and the horizontal component force being transmitted to the side walls of the frame via the vertical pads 25. The driving devices, the pads and the vertical pads on the force transmitting path are all located at the middle region of the axis of the working roll, being within the length of the roll body.

Therefore, the rolling mill of the invention guarantees the proper shape, namely, the linearity of the generating line of the working rolls not only in the vertical plane but also in the horizontal plane. As a result, the flexural deformation of the working rolls do not vary with the rolling force in the main. Therefore, the rolls flexural deformation is significantly reduced, resulting in the reduction of the thickness error of the rolled strips.

The adjustment of the clearance between the rolls is accomplished by moving the upper middle roll support 8 and the upper lateral roll support 6 up and down together in the window of the frame 10, the upper middle roll support 8 and the upper lateral roll support 6 are driven by the driving devices 9.

The rolling mill of the embodiment can be placed upside down, and accordingly the downward acting driving devices become upward acting driving devices. Such a modification may have the same effects.

The hydraulic downward acting driving devices can also be replaced by a screw device.

The pads can be replaced by the bosses or protuberances provided on the frame or the roll supports, and the pads can also be stacked pads.

Compared with the prior art, the invention has the following advantages:

Since the rolling mill of the invention has an integral frame the shape of which corresponds to the contour outline of the combined roll supports and the frame is of very high rigidity; the pads or the clearance adjusting devices between the middle roll supports and the lateral roll supports, and the pads between the roll supports and the frame are located in the middle region of the axis of the working roll and are within the length of the roll body of the working roll, and form a two-dimensional automatic central supporting system. Thus, the shape of the generating line of the working rolls is guaranteed not only in the vertical plane but also in the horizontal plane. As a result, the bending deformation of the working rolls does not vary with the rolling force in the main, resulting in the remarkable reduction of the thickness error of the rolled strips.

The rolling mill of the invention can greatly simplify the cambering or the design of the roll shape and the control of the roll shape during rolling. The bending deformations of the working rolls of the inventive rolling mill in both the horizontal and vertical directions do not vary with the rolling forces in the main. Since the bending deformation, which is the most important factor among the various factors associated with the cambering such as the bending deformation, flattening deformation, heat expansion and wear etc., can be left out of consideration, and the heat expansion and wear are also slowly changing factors, the design of the roll shape and the control of the roll shape during rolling can be greatly simplified. In addition, the "roll pass" formed by the bending deformations of the two working rolls of a conventional rolling mill is eliminated, thus facilitating the transverse flow of the metal and being advantageous to roll high-precision strips with wedge-shaped blanks, and the phenomenon of the "edge attenuation" of strips is greatly improved.

In the above mentioned embodiment of the invention, the number of the rolls in the roll system is 12, but the roll systems may have different number of rolls. In addition, the combined roll supports of the invention can mate with the roll supports or the roll systems in a conventional rolling mill.

The invention is not limited to cold rolling mills, and is also applicable to hot-rolling mills for rolling strips.

Although the preferred embodiments of the invention have been described, to persons skilled in the art, various modifications can be made to the invention without going beyond the scope of the attached claims of the invention.

What is claimed is:

1. A rolling mill for rolling plate and strip, comprising:

a mill frame, an upper roll system and lower roll system, an upper roll support and a lower roll support, and a driver operable to adjust the clearance between the rolls, said upper and lower roll systems being stacked one on top of the other, wherein at least one of the roll supports comprises:

a first middle roll support, first lateral roll supports located on either side of the first middle roll support and first central supporting means positioned between said first middle roll support and each of said first lateral roll supports, and wherein said first lateral supports are operable to slide laterally in the horizontal direction relative to said first middle roll support; second central supporting means being disposed between the frame and said first middle roll support, and third central supporting means being disposed between the frame and said first lateral roll supports; said first, second and third central supporting means being arranged in the middle region of the axis of a roll body of a working roll with their lengths not longer than that of the roll body of the working roll; said frame, said one of the roll supports, first, second and third central support means together forming a first two-dimensional automatic central supporting system; in the operation state of the rolling mill, said first and third central supporting means abut against a corresponding first lateral roll support at the central region of the first lateral roll support in the axial direction of the rolls; and said second central supporting means abuts against said first middle roll support at the central region of the first middle roll support in the axial direction of the rolls.

2. The rolling mill as claimed in claim 1, wherein said driver is disposed between the frame and said first middle roll support and is used as said second central supporting means.

3. The rolling mill as claimed in claim 1, wherein the other of the roll supports comprises:

a second middle roll support, second lateral roll supports located on either side of the second middle roll support and fourth central supporting means positioned between said second middle roll support and each of said second lateral roll supports, and wherein said second lateral roll supports are operable to slide laterally in the horizontal direction relative to said second middle roll support;

fifth central supporting means being disposed between the frame and said second middle roll support, and sixth central supporting means being disposed between the frame and said second lateral roll supports; said fourth, fifth and sixth central supporting means being arranged in the middle region of the axis of the roll body of a working roll with their length not longer than that of the roll body of the working roll; said frame, said other of the roll supports, fourth, fifth and sixth central support means together forming a second two-dimensional automatic central supporting system; in the operation state of the rolling mill, said fourth and sixth central supporting means abut against a corresponding second lateral roll support at the central region of the second lateral roll support in the axial direction of the rolls; and said fifth central supporting means abuts against said second middle roll support at the central region of the second middle roll support in the axial direction of the rolls.

4. The rolling mill as claimed in claim 3, wherein:

said fifth central supporting means comprises horizontal pads;

said third and sixth central supporting means comprises vertical pads which abut tightly against the inner side walls of the mill frame and the corresponding side surface of the first and second lateral roll supports under the action of a horizontal component force, and said first and fourth central supporting means comprise pads.

5. The rolling mill as claimed in claim 1, wherein said frame is an integral casting frame, or is assembled to an integral one by welding, with a window formed in its outer wall.

6. The rolling mill as claimed in claim 1, wherein arranged at an outermost layer of said roll systems are supporting rolls, the supporting rolls are in a form of a multi-section beam with more than two sections.

7. The rolling mill as claimed in claim 2, wherein said driver is hydraulic or electric driving means.

8. The rolling mill as claimed in claim 4, wherein said pads are protuberances or bosses provided on the frame or the roll supports.

* * * * *